US010442503B2

(12) United States Patent
Shearer et al.

(10) Patent No.: US 10,442,503 B2
(45) Date of Patent: Oct. 15, 2019

(54) TUBING WITH INTERNAL CHANNEL

(71) Applicant: Taylor Made Group, LLC, Gloversville, NY (US)

(72) Inventors: Robert R. Shearer, Bradenton, FL (US); Dennis J. Parniske, Parrish, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 47 days.

(21) Appl. No.: 15/082,971

(22) Filed: Mar. 28, 2016

(65) Prior Publication Data

US 2016/0281885 A1 Sep. 29, 2016

Related U.S. Application Data

(60) Provisional application No. 62/139,367, filed on Mar. 27, 2015.

(51) Int. Cl.
*B63B 17/02* (2006.01)

(52) U.S. Cl.
CPC ..... *B63B 17/02* (2013.01)

(58) Field of Classification Search
CPC ..... B63B 17/02; E04G 1/12
USPC ..... 138/108, 116, 117, 115, 111, DIG. 11; 403/49, 353, DIG. 4
See application file for complete search history.

(56) References Cited

U.S. PATENT DOCUMENTS 3,814,835 A * 6/1974 Merry ..... B63B 15/0083 114/90
4,463,057 A * 7/1984 Knurr ..... A47B 96/1466 191/22 DM
4,838,294 A * 6/1989 Hunt ..... E04H 6/44 135/124
4,926,605 A * 5/1990 Milliken ..... B63B 17/00 160/392
5,085,485 A * 2/1992 Wurl ..... B62D 29/008 293/155
5,555,695 A * 9/1996 Patsy, Jr. ..... E04H 15/58 52/222
5,839,388 A 11/1998 Vadney
6,026,761 A 2/2000 Parniske et al.
6,408,587 B2 * 6/2002 Cronin ..... E04C 3/04 52/637
6,647,692 B1 * 11/2003 Roder ..... E04C 3/29 428/36.9
6,972,367 B2 * 12/2005 Federspiel ..... H02G 3/0418 174/481
7,063,096 B2 * 6/2006 Stoeckler ..... E04H 15/46 135/114
7,114,687 B2 * 10/2006 Swantner ..... F16L 3/10 248/74.2
7,128,585 B2 * 10/2006 Evilsizer ..... H01R 25/14 439/120
7,650,724 B2 * 1/2010 Hallett ..... A47C 5/04 114/361

(Continued)

*Primary Examiner* — Craig M Schneider
*Assistant Examiner* — David R Deal
(74) *Attorney, Agent, or Firm* — Nixon & Vanderhye P.C.

(57) ABSTRACT

A tubing member includes an outer periphery delimiting a tubing interior and a slot opening therein. A channel is positioned adjacent the slot opening in the tubing interior and is integral with the outer periphery. The channel is accessible via the slot opening.

17 Claims, 5 Drawing Sheets

(56) References Cited

U.S. PATENT DOCUMENTS

| | | | | |
|---|---|---|---|---|
| 7,753,082 | B2 * | 7/2010 | Anno | F16L 11/20 138/108 |
| 7,757,722 | B1 * | 7/2010 | Lesch, Jr. | F16L 59/024 137/375 |
| 7,934,331 | B2 * | 5/2011 | Zlotocha | A47G 1/16 40/735 |
| 8,950,908 | B2 * | 2/2015 | Berman | F21V 15/013 220/3.7 |
| 2006/0239781 | A1 * | 10/2006 | Kliefoth | E02D 27/02 405/229 |

* cited by examiner

TUBING WITH INTERNAL CHANNEL

CROSS-REFERENCES TO RELATED APPLICATIONS

This application claims the benefit of U.S. Provisional Patent Application No. 62/139,367, filed Mar. 27, 2015, the entire content of which is herein incorporated by reference.

STATEMENT REGARDING FEDERALLY SPONSORED RESEARCH OR DEVELOPMENT (Not Applicable)

BACKGROUND OF THE INVENTION

The invention relates to tubing for use as part of an assembly for supporting an object and, more particularly, to tubing incorporating an internal channel to accommodate attachments and/or peripheral devices as well as for adding to the structural integrity of the tubing.

Tubing in various cross-sections has a multitude of uses as a structural component forming part of an assembly for supporting an object. Depending on the object to be supported and the construction of the assembly, the structural integrity of the tubing may be significant. Conventional tubing typically lacks any structural configurations for accommodating attachments.

BRIEF SUMMARY OF THE INVENTION

In some embodiments, a channel or cavity is introduced into tubing thereby allowing the cavity to be used for a variety of purposes. The tubing could be used in a marine environment to support a canvas bimini or as a railing on pontoon boats or in architecture. The profile is also suitable for use in screen porch construction, golf carts and many other applications as would be apparent to those of ordinary skill in the art.

In an exemplary embodiment, tubing comprises an outer periphery delimiting a tubing interior and including a slot opening therein, and a channel positioned adjacent the slot opening in the tubing interior and integral with the outer periphery, the channel being accessible via the slot opening. The outer periphery may be substantially square or rectangular, or at least a portion of the outer periphery may be rounded. The channel may be U-shaped. Intersections between the outer periphery, the slot opening and the channel may define at least one shoulder. A width of the channel adjacent the slot opening may be greater than a width of the slot opening. A depth of the channel may extend less than half way into a depth of the tubing interior. The slot opening and the channel may be relatively sized to receive a snapless attachment system. The channel may be sized to receive a light strip, and the slot opening may be sized to contain the light strip in the channel. The tubing may have a higher stiffness than similarly sized tubing without a channel.

In another exemplary embodiment, a structural component forming part of an assembly for supporting an object includes a tubing member delimiting a tubing interior and including a slot opening; and a channel positioned adjacent the slot opening and integral with the tubing. The channel is disposed in the tubing interior, and the channel is positioned to receive a connector secured to the object. A width of the channel adjacent the slot opening is greater than a width of the slot opening.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
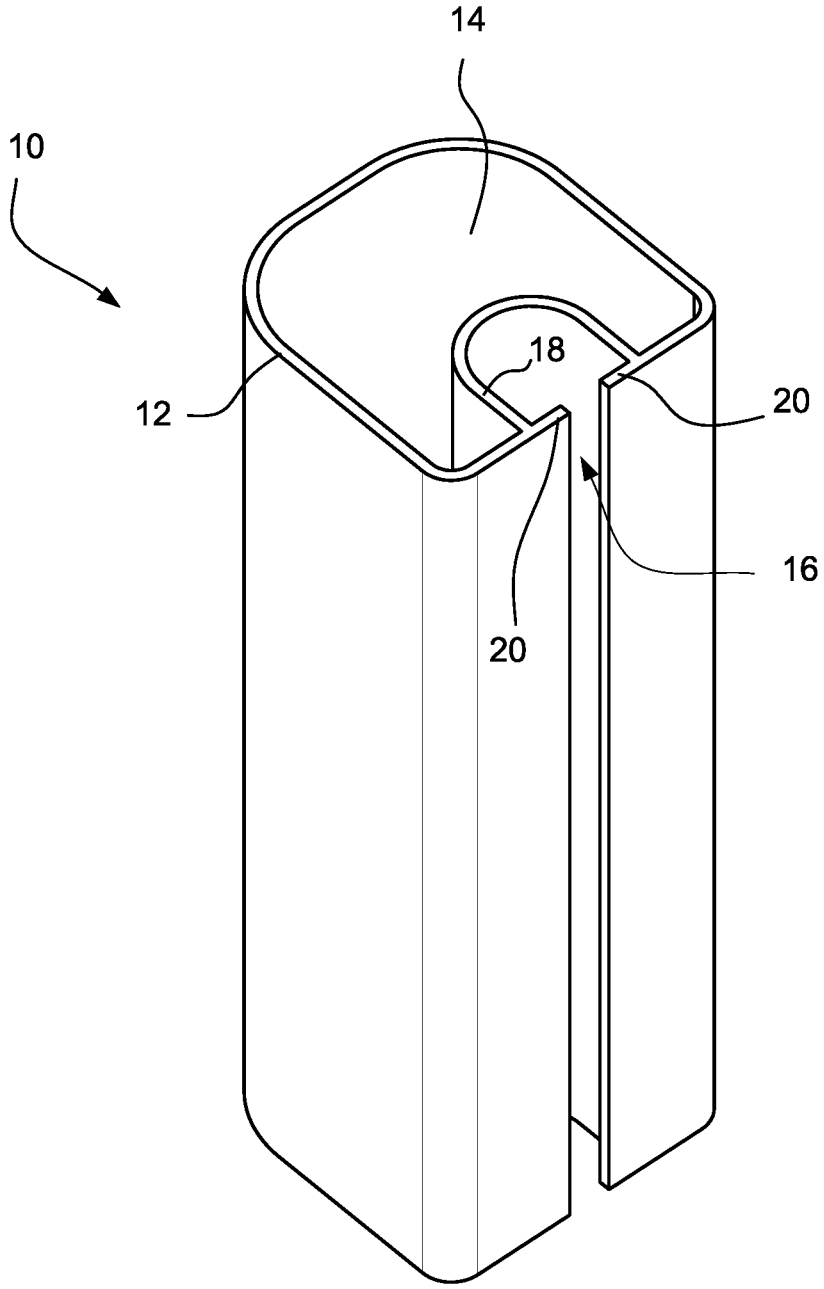
FIGS. 1 and 2 are perspective views showing the tubing according to preferred embodiments.

With reference to the drawings, a channel or cavity is introduced into tubing thereby allowing the channel to be used for a variety of purposes. The tubing 10 includes an outer periphery 12 delimiting a tubing interior 14. The outer periphery 12 includes a slot or slot opening 16 therein. The cavity or channel 18 is positioned within the tubing interior 14 adjacent the slot opening 16. Preferably, the channel 18 is formed integral with the outer periphery 12. As shown, the channel 18 is accessible via the slot opening 16.

Figure 2:
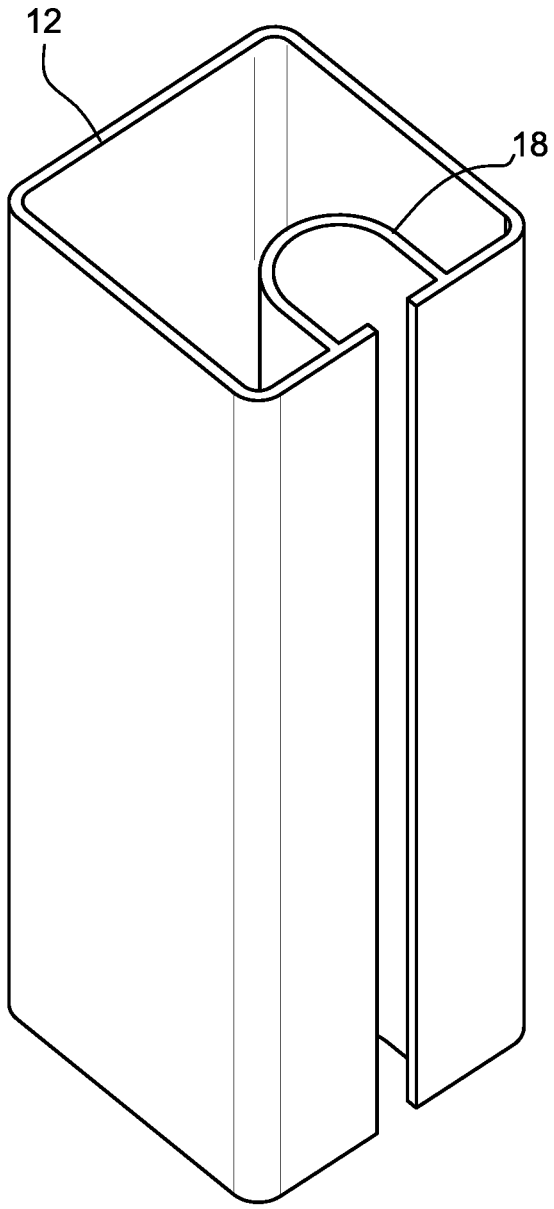

A shape of the outer periphery 12 may be traditional square, round, oval, rectangular and the like or combinations including square and round or multi-faceted. FIG. 1 shows the outer periphery having at least one portion being rounded or a so-called square-round shape. FIG. 2 shows the outer periphery 12 being substantially square. By "substantially," the square shape may include rounded corners and/or other slight variations to an exact square.

The channel 18 is generally U-shaped as shown in FIGS. 1 and 2. Intersections between the outer periphery 12, the slot opening 16 and the channel 18 define at least one shoulder 20. That is, a width of the channel 18 adjacent the slot opening 16 is greater than a width of the slot opening 16, thereby defining the shoulders 20. The shoulders 20 may serve to retain connectors or the like supported in the channel 18. For example, a resilient connector may be displaced for insertion through the slot opening 16 that is subsequently expanded in the channel 18 to secure an object in the channel 18. The shoulders 20 serve to better secure the resilient connector or the like in the channel 18. In some embodiments, a depth of the channel 18 extends less than halfway into a depth of the tubing interior 14.

The tubing may form part of an assembly for supporting an object. For example, the tubing may be used as the structure for supporting a canvas bimini or other enclosures may be constructed from connected tubing. The tubing may also be used as a railing on pontoon boats or in architecture. In addition, the profile could be used in screen porch construction. This structure is also suitable for golf carts and many other applications as would be apparent to those of ordinary skill in the art. The invention is not meant to be limited to the described embodiments.

Figure 3:
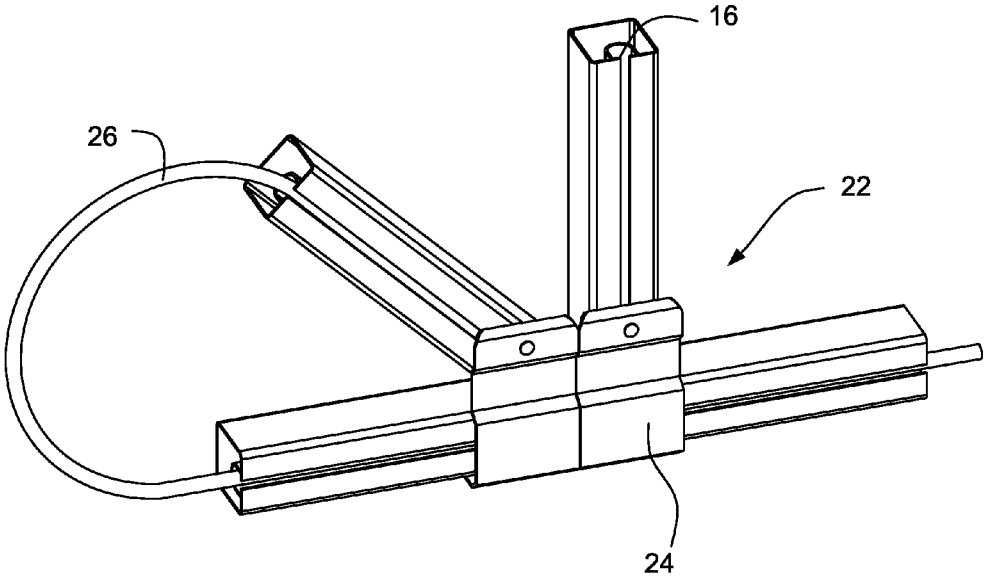
FIG. 3 shows part of an assembly for supporting an object and incorporating a light strip accessory.

FIG. 3 shows a portion of an assembly 22 with tubing sections secured via a suitable connector 24. In the embodiment shown in FIG. 3, the channel is sized to receive a light strip 26, and the slot opening 16 is sized to contain the light strip 26 in the channel 18.

In some embodiments, the slot opening 16 and the channel 18 are relatively sized to receive a snapless attachment system such as the system described in U.S. Pat. No.

Figure 4:
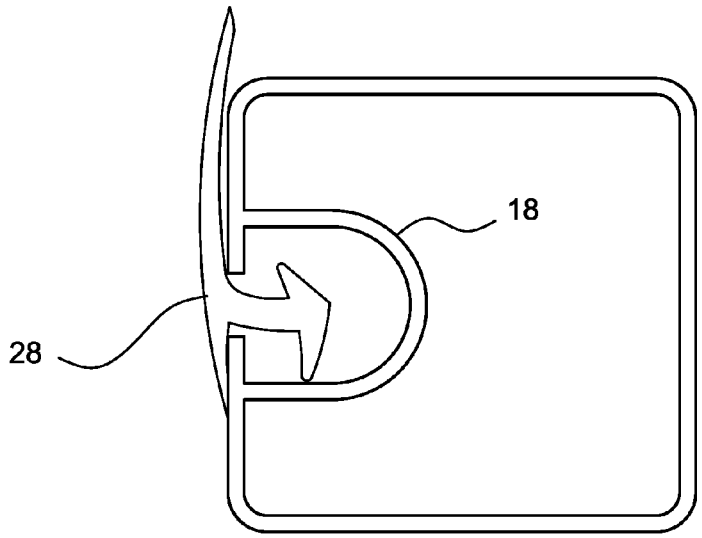
FIG. 4 is a sectional view of the tubing showing a trim member supported in the channel.

6,026,761, the contents of which are hereby incorporated by reference. FIG. 4 shows an exemplary snapless attachment member 28 secured in the channel 18.

Figure 5:
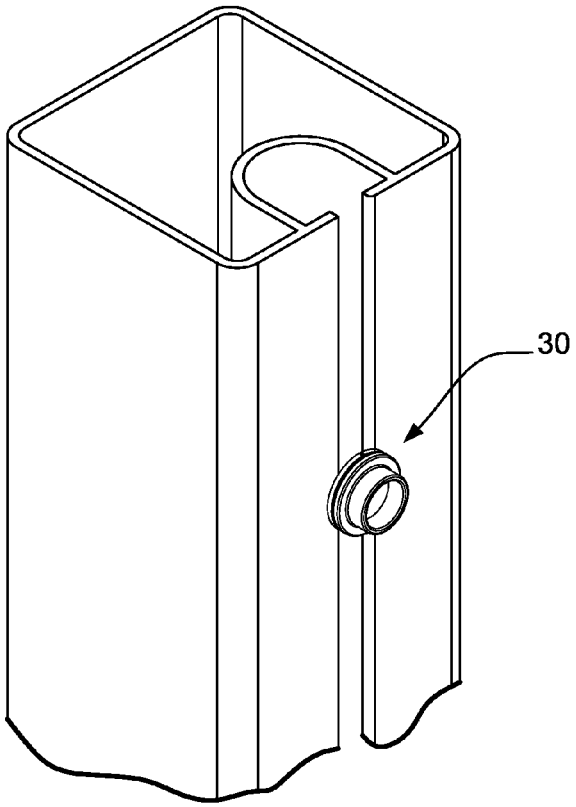
FIG. 5 is an exemplary application with a snap stud secured in the tubing channel.

In other embodiments, the cavity is shaped to receive the clip assembly of U.S. Pat. No. 5,839,388, the contents of which are hereby incorporated by reference. In FIG. 5, the clip assembly of the '388 patent supports a snap stud 30 for supporting a canvas cover or the like. Other attachments may include an awning welt (Keder Welt), interlocking and adjustable locating attachments, and the like.

Figure 6:
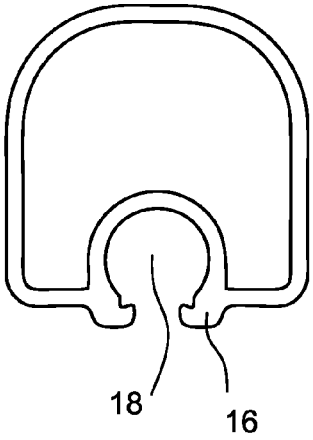
FIGS. 6-8 show alternative constructions of the tubing.
Figure 7:
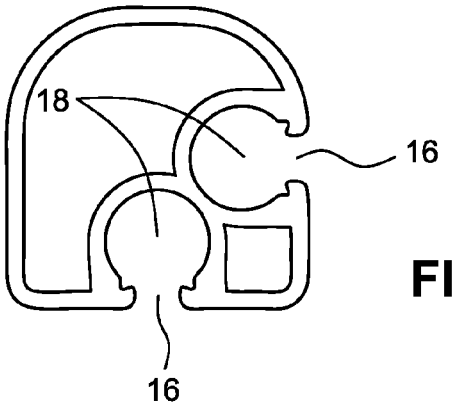
Figure 8:
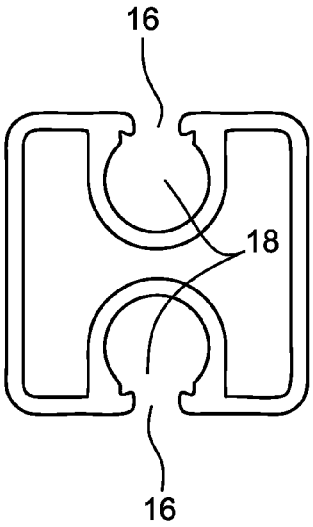

With reference to FIG. 6, in some embodiments, the slot opening 16 may protrude out from the channel 18. With reference to FIGS. 7 and 8, in some embodiments, the tubing may include multiple channels 18 and corresponding multiple slot openings 16. The location of the openings 18 could be on adjacent (FIG. 7) or lateral (FIG. 8) faces of the profile.

Advantages of the described embodiments may include:

- The cavity or channel adds to the structural integrity of the profile thereby increasing its stiffness
- The channel allows for the integration of lighting into the profile/tubing by providing a receiver for rope or flat strip type LED lights.
  - This could serve as integrated decorative or functional lighting
- The clip assembly of the noted '388 patent could allow for attachment of fasteners (snap studs, screws) to the cavity
- Allows for the use of the SureSeal™ attachment system as described in the noted '761 patent
  - Canvas could be attached to the SureSeal™ and directly attached to the tubing
  - SureSeal™ could be used to replace zippered and sewn bow pockets on marine tops
    - Thereby eliminating the "duck bill" look commonly associated with the bow pockets
    - Would reduce the amount of sewn-in stitching associated with the bow pockets by approximately one half thereby reducing exposed stitching and labor
    - SureSeal™ attached bow pockets would allow for better fitting marine tops as well as longer zipper connections on the side curtains
- The channel could accept a standard sized awing welt (Keder welt)
- The tubing could be used for marine tops or enclosures, hand railing on pontoon style boats, hand railing in architectural applications, screen porch enclosure applications, and sign, banner, and curtain applications
  - For architectural and screen porch applications (possibly used in marine applications), the cavity could be used to permanently or temporarily attach screens, banners, privacy curtains, etc.
- The cavity could provide a receiver to attach custom sliding, or re-positional, attachments such as hinges, jaw slides, or other conceived attachment accessories If rounded edges are combined onto the square tubing (or rectangular), i.e., the square-round cross section, with the receiving cavity, then there are distinct advantages as follows:

- The rounded tubing provides for a smoother looking profile
- The structural stiffness, when rounds and cavity are added, is similar to that of equivalent sized and walled square tubing
- The square-round with cavity is significantly stiffer than that of equivalent sized and walled round tubing
- The square-round tubing appears to look round from the outboard side (as used in the marine top application) and square from the inboard side
- The rounds, on the square-round profile, provide a smoother surface contacting the canvas thereby reducing canvas rub or abrasion
- The square-round section provides for a smoother transition from a bimini top to a forward or camper top
- The square-round tubing provides for a smoother transition between a radar arch or tower than square tubing and is stronger or stiffer than equivalent sized and walled round tubing
- Standard external square tube canvas fittings can be used with the square-round tubing
- The square-round profile should also aid in the patterning process where the rounded surface provides for easier patterning techniques than that of the square profile While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. Tubing comprising:

an outer periphery delimiting a tubing interior, the outer periphery including a front wall with a slot opening therein, side walls extending from the front wall, and a back wall connecting the side walls, wherein the back wall is continuously linear between the side walls, and wherein the entire front wall has a consistent thickness; and a channel positioned adjacent the slot opening in the tubing interior, the channel being integral with the front wall of the outer periphery on a slot side of the outer periphery and spaced from an inside surface of the outer periphery on the side walls and the back wall of the outer periphery, the channel being accessible via the slot opening, wherein the channel intersects the front wall of the outer periphery on opposite sides of the slot at essentially right angles, and wherein the channel is positioned closer to both of the side walls of the outer periphery than the back wall of the outer periphery.

2. Tubing according to claim 1, wherein the outer periphery is substantially square or rectangular.

3. Tubing according to claim 1, wherein at least a portion of the outer periphery is rounded.

4. Tubing according to claim 1, wherein the channel is U-shaped.

5. Tubing according to claim 1, wherein intersections between the outer periphery, the slot opening and the channel define at least one substantially right angle shoulder.

6. Tubing according to claim 5, wherein each of the intersections between the outer periphery, the slot opening and the channel defines a substantially right angle shoulder in the tubing interior, and wherein a width of the slot opening is substantially equivalent to a width of each of the shoulders.

7. Tubing according to claim 1, wherein a depth of the channel extends less than half way into a depth of the tubing interior.

8. Tubing according to claim 1, wherein the slot opening and the channel are relatively sized to receive a snapless attachment system.

9. Tubing according to claim 1, wherein the channel is sized to receive a light strip, and wherein the slot opening is sized to contain the light strip in the channel.

10. Tubing according to claim 1, comprising a higher stiffness than similarly sized tubing without a channel.

11. A structural component forming part of an assembly for supporting an object, the structural component comprising:

a tubing member delimiting a tubing interior and including a slot wall with a slot opening; and a channel positioned adjacent the slot opening, the channel being integral with an inside surface of the tubing member on a slot side of the tubing member and spaced from the inside surface of the tubing member on non-slot sides of the tubing member, wherein except for transitions among the non-slot sides of the tubing member, each of the non-slot sides is continuously linear across a width thereof, the channel being disposed in the tubing interior, wherein the channel is positioned to receive a connector secured to the object, wherein a width of the channel directly adjacent the slot opening is greater than a width of the slot opening, wherein the slot opening is centered in the slot wall, and wherein the width of the slot opening is substantially equivalent to a distance that the slot wall extends into the width of the channel on each side of the slot opening.

12. A structural component according to claim 11, wherein an outer periphery of the tubing member is substantially square or rectangular.

13. A structural component according to claim 11, wherein at least a portion of an outer periphery of the tubing member is rounded.

14. A structural component according to claim 11, wherein the channel is U-shaped.

15. A structural component according to claim 11, wherein intersections between an outer periphery of the tubing member, the slot opening and the channel define at least one shoulder in the tubing interior.

16. A structural component according to claim 15, wherein each of the intersections between the outer periphery, the slot opening and the channel defines a shoulder.

17. A structural component according to claim 11, wherein a depth of the channel extends less than half way into a depth of the tubing interior.

* * * * *